US006325223B1

(12) United States Patent
Hannen

(10) Patent No.: US 6,325,223 B1
(45) Date of Patent: Dec. 4, 2001

(54) DISPLAY WALL SECTION

(75) Inventor: Timothy Hannen, Linden, NJ (US)

(73) Assignee: Patwin Plastics, Inc., Linden, NJ (US)

( * ) Notice: Subject to any disclaimer, the term of this patent is extended or adjusted under 35 U.S.C. 154(b) by 0 days.

(21) Appl. No.: 09/276,767

(22) Filed: Mar. 26, 1999

(51) Int. Cl.[7] ..... A47F 5/08
(52) U.S. Cl. ..... 211/87.01
(58) Field of Search ..... 211/87.01, 94.01, 211/189; 248/220.21, 222.11

(56) References Cited

U.S. PATENT DOCUMENTS

| | | | | |
|---|---|---|---|---|
| D. 165,978 | | 2/1952 | Haman et al. . | |
| D. 307,260 | | 4/1990 | Happy et al. . | |
| D. 395,089 | | 6/1998 | Current . | |
| D. 399,010 | | 9/1998 | Current . | |
| 2,246,448 | | 6/1941 | Mahan, Jr. . | |
| 3,655,065 | | 4/1972 | Yellin . | |
| 4,377,231 | | 3/1983 | Murphy . | |
| 4,527,697 | | 7/1985 | Mastrodicasa . | |
| 4,531,331 | | 7/1985 | Itagaki . | |
| 4,591,058 | | 5/1986 | Amstutz et al. . | |
| 4,592,601 | | 6/1986 | Hlinsky et al. . | |
| 4,603,068 | | 7/1986 | Hunter . | |
| 4,607,753 | | 8/1986 | Radek . | |
| 4,615,448 | | 10/1986 | Johnstonbaugh . | |
| 4,674,240 | | 6/1987 | Strausheim . | |
| 4,678,151 | * | 7/1987 | Radek | 211/94.01 X |
| 4,694,965 | | 9/1987 | Parnell . | |
| 4,805,783 | | 2/1989 | Mayer . | |
| 4,809,479 | | 3/1989 | Tierno et al. . | |
| 4,936,472 | | 6/1990 | Meier . | |
| 5,147,120 | | 9/1992 | Ray . | |
| 5,170,605 | | 12/1992 | Huddle . | |
| 5,191,983 | | 3/1993 | Hardy . | |
| 5,192,042 | | 3/1993 | Wotring et al. . | |
| 5,224,610 | * | 7/1993 | Veazey | 211/87.01 |
| 5,409,120 | | 4/1995 | Miller et al. . | |
| 5,412,912 | * | 5/1995 | Alves | 211/94.01 X |
| 5,485,394 | | 1/1996 | Holztrager . | |
| 5,647,184 | | 7/1997 | Davis . | |
| 5,819,490 | | 10/1998 | Current . | |
| 5,899,344 | * | 5/1999 | Current et al. | 211/94.01 |
| 5,941,026 | * | 8/1999 | Eisenreich et al. | 211/87.01 X |

FOREIGN PATENT DOCUMENTS

| | | | |
|---|---|---|---|
| 340433 | * | 9/1959 | (CH) . |

* cited by examiner

*Primary Examiner*—Daniel P. Stodola
*Assistant Examiner*—Curtis A. Cohen
(74) *Attorney, Agent, or Firm*—Oblon, Spivak, McClelland, Maier & Neustadt, P.C.

(57) ABSTRACT

A display wall section having features that aid in the alignment and mounting of the display wall section to a support surface. The display wall section has a first end portion with an alignment member and a second end portion with a recessed section adapted to receive and hold the alignment member therein during installation of the display wall sections. The alignment member includes an inclined surface that leads to a hook portion that extends above a front surface of the display wall section. The recessed section includes an inclined surface leading to a protruding edge that extends from a rear surface of the display wall section. The display wall system includes a plurality of the display wall sections and U-shaped edge members configured to fit over the edges of the display wall sections.

20 Claims, 8 Drawing Sheets

DISPLAY WALL SECTION

FIELD OF THE INVENTION

The present invention relates to display walls, and in particular, to a display wall section for mounting to a supporting surface.

BACKGROUND OF THE INVENTION

Retail stores conventionally stock a wide variety of items having different shapes and sizes. Many retail stores also tend to move items around the store for a variety of reasons, for example, depending on the time of the year for seasonal products or for specific sales or simply to rearrange displays. Retail sales stores have long been in need of display walls for merchandise that are versatile and provide for the hanging or displaying of a variety of items and for the reconfiguration of merchandise displays. Similarly, the individual consumer has long sought display walls that can be used to store various items such as tools and/or could be used to create a versatile shelving system to store a variety of items in the home, office, or garage.

In order for a display wall to be a commercially attractive product for retail stores and individual consumers, the display wall system should be inexpensive and easy to install. If the cost of the product is high and the amount of labor required to install the product is great, than the appeal of such a display wall will be greatly reduced. Additionally, the display wall must be aesthetically attractive so as to provide an attractive merchandise display or storage shelving system.

Slatwall products have been developed to provide a display wall capable of providing a relatively versatile system of displaying merchandise. For example, FIG. 10 depicts a slatwall section 100 including a base portion 102 having a front surface 104, a rear surface 105, a top portion 106 and a bottom portion 110. The base portion 102 has a plurality of slats 115 that project from the front surface 104 of the base portion 102. The slats 115 include a first portion 118 extending from the front surface 104 of the base portion 102 and a second portion 116 that extends in a direction parallel to the base portion 102. The second portion 116 includes an upwardly projecting lip 120 and a downwardly projecting lip 122. The upwardly projecting lip 120 and the downwardly projecting lip 122 on a slat work in conjunction with an upwardly projecting lip 120 and a downwardly projecting lip 122 on an adjacent slat to receive and hold display supports (not depicted).

The bottom portion 110 of the slatwall section 100 includes an elongated section 112 having a U-shaped portion 114 that extends beyond a lowermost slat 126 and downwardly projecting lip 128, and the top portion 106 includes a lip 108 that projects perpendicularly from the base portion 102 and is positioned behind an upwardly projecting lip 125 of an uppermost slat 124. The U-shaped portion 114 of a slatwall section 100 can be used in conjunction with the lip 108 of an adjacent slatwall section 200 to lock the slatwall sections together during installation.

The tight configuration between the lip 108 of slatwall section 200, the U-shaped portion 114 of slatwall section 100, and the upwardly projecting lip 125 of slatwall section 200 depicted in FIG. 10 is necessary in order to ensure a locking relationship between the adjacent slatwall sections, 100 and 200. The positioning of the lip 108 behind the upwardly projecting lip 125 and the tight configuration between the lip 108 of slatwall section 200, the U-shaped portion 114 of slatwall section 100, and the upwardly projecting lip 125 of slatwall section 200, makes installation of the slatwall sections 100 and 200 difficult. For example, the U-shaped portion 114 and the lip 108 must be connected together by mating the U-shaped portion 114 and the lip 108 at opposing side edges of the slatwall sections 100 and 200, respectively, and sliding one of the slatwall sections in a direction parallel to the slats 115. As the first slatwall section is typically mounted to a wall then a second slatwall section is mounted either below or above the first slatwall section, the second slatwall section must be slid along the wall in order to connect the lip 108 and the U-shaped portion 114 of the adjacent slatwall sections 100 and 200. Since the slatwall section are typically formed as wide units, and since the mounting wall may have numerous irregularities which could prevent the second slatwall section from sliding smoothly along the wall during connection with the first slatwall section, the slatwall configuration depicted in FIG. 10 is not ideal.

U.S. Pat. No. 5,819,490 (hereinafter referred to as "the '490 patent") describes a slatwall section having a body with a plurality of spaced slats for receiving hangers and other display devices. The slatwall section (10) includes a lower coupling leg (20) and an upper coupling leg (16). The lower coupling leg (20) has a notch (22) provided on a rear side thereof for receiving the upper coupling leg (16) of another slatwall section. FIG. 1*b* depicts the coupling of two slatwall sections (12*b* and 12*c*) using a fastener (28). The upper coupling leg (16) of slatwall (12*c*) is matingly joined with the lower coupling leg (20) of slatwall section (12*b*) such that the holes (18 and 24) are axially aligned with each other, and leg (16) abuts notch (22). Once positioned such that holes (18 and 24) are axially aligned, fastener (28) is inserted therethrough to secure the connection between slatwall sections. The placement of holes (18 and 24) in the overlapping leg portions (16 and 20), respectively, forms the connection point of the two slatwall sections within slat (14).

The '490 patent also does not provide an ideal structure as the ends of the slatwall sections described therein fail to provide a structure that allows for easy alignment of adjacent sections during installation. Assuming the upper coupling leg (16) is positioned above the lower coupling leg (20) of slatwall section (12*a*) during mounting to the wall and assuming a lower coupling leg of an adjacent slatwall section is positioned adjacent the upper coupling leg (16) of the slatwall section (12*a*), one or more fasteners (28) must be positioned within the holes (18 and 24) in order to maintain the coupling of the adjacent slatwall section with slatwall section (12*a*) and to ensure proper alignment. It would be difficult for an installer to simultaneously position and hold the lower coupling leg of the adjacent slatwall section adjacent the upper coupling leg (16) of the slatwall section (12*a*), align the holes (18 and 24), and insert one or more fastening members (28) within the holes (18 and 24) in order to align the slatwall sections. Installation would be even more difficult if the adjacent slatwall section is mounted below the already mounted slatwall section (12*a*), as the upper coupling leg of the adjacent slatwall section would simply slide out of the notch (22) of the slatwall section (12*a*) under the force of gravity until the fastening members (28) are inserted within the holes (18 and 24).

Consequently, a need exists for a display wall section that includes features to aid in the alignment of adjacent display wall section in order to facilitate ease of installation of such display wall sections.

SUMMARY OF THE INVENTION

The present invention relates generally to a display wall section having features that aid in the alignment and mounting of the display wall section to a support surface. The present invention achieves this result by providing a display wall section having a first end portion with an alignment member having an inclined surface and a second end portion with a recessed section adapted to receive and hold the alignment member therein during installation of the display wall sections.

The present invention advantageously provides a display wall section that includes a base portion having a first end portion, and a second end portion. The exemplary embodiment of the display wall section includes a base portion having a first end portion and a second end portion. The first end portion has an alignment member that is preferably located beyond an adjacent lip portion of an adjacent outermost slat. The alignment member includes an inclined surface that preferably begins at a rear surface of the base portion and extends in the direction of a front surface at an oblique angle between zero and ninety degrees towards the adjacent outermost slat, and leads to a hook portion that extends above the front surface of the base portion. The alignment member has a generally wedge-shaped cross-section.

The exemplary embodiment of the display wall section further includes a recessed section located at the second end portion that extends beneath an adjacent outermost slat. The recessed section is preferably located such that an adjacent lip portion of an adjacent outermost slat extends beyond the recessed section. The recessed section includes an inclined surface leading to a protruding edge that extends from the rear surface of the base portion. The recessed section is preferably integral with a projection of the adjacent outermost slat.

The exemplary embodiment of the present invention is constructed with a base portion having one or more slats having a generally T-shaped cross-section. The slats are used for attaching display hooks that are anchored or positioned between adjacent slats and act as cantilever beams for hanging various display items or display shelves.

The present invention further advantageously provides a display wall system including a plurality of display wall sections as described above. The display wall system preferably includes U-shaped edge members configured to fit over the edges of the display wall sections. The edge members are constructed to provide an aesthetically pleasing appearance to the display wall system by hiding the edges of the display wall system, and to prevent display racks held by the slats from sliding off the edges of the display wall sections.

The display wall section is positioned on a supporting surface with either the first end portion or the second end portion positioned at the top, and with the slats extending in a horizontal direction. Once a first display wall section is mounted on the supporting surface a second display wall section can be positioned below the first display wall section such that the alignment member of the second display wall section is received within the recessed section of the first display wall section. Since the first display wall section is mounted to a supporting surface and therefore the recessed section is positioned near the wall, as the second display wall is slid into position adjacent the first display wall the hook portion of the first display wall will slightly interfere with the protruding edge of the second display wall. Consequently, the alignment member of the first display wall can be pushed against the recessed section of the second display wall such that the alignment member snaps into position within the recessed section, and thereby the protruding edge of the second end portion tends to hold the hook portion of the alignment member within the recessed section. Once the alignment member of the first display wall is moved within the recessed section of the second display wall, the first display wall facilitates the alignment and installation of the second display wall on the supporting surface by either holding the second display wall section in place or at least provide an easy reference by which the second display wall section can be aligned.

Additional advantages and other features of the invention will be set forth in part in the description which follows and in part will become apparent to those having ordinary skill in the art upon examination of the following or may be learned from the practice of the invention. The advantages of the invention may be realized and obtained as particularly pointed out in the appended claims.

DETAILED DESCRIPTION OF THE INVENTION

The present invention relates generally to a display wall section having features that aid in the alignment and mounting of the display wall section to a support surface. The present invention advantageously provides alignment features that can be utilized with a wide variety of shapes and styles of display wall sections. FIGS. 1–7 depict an exemplary embodiment of a display wall section that includes an embodiment of the unique alignment features as contemplated by the present invention. The exemplary embodiment depicted in FIGS. 1–7 is merely one example of a display wall section according to the present invention and does not limit the scope of the claims included herein.

Figure 1:
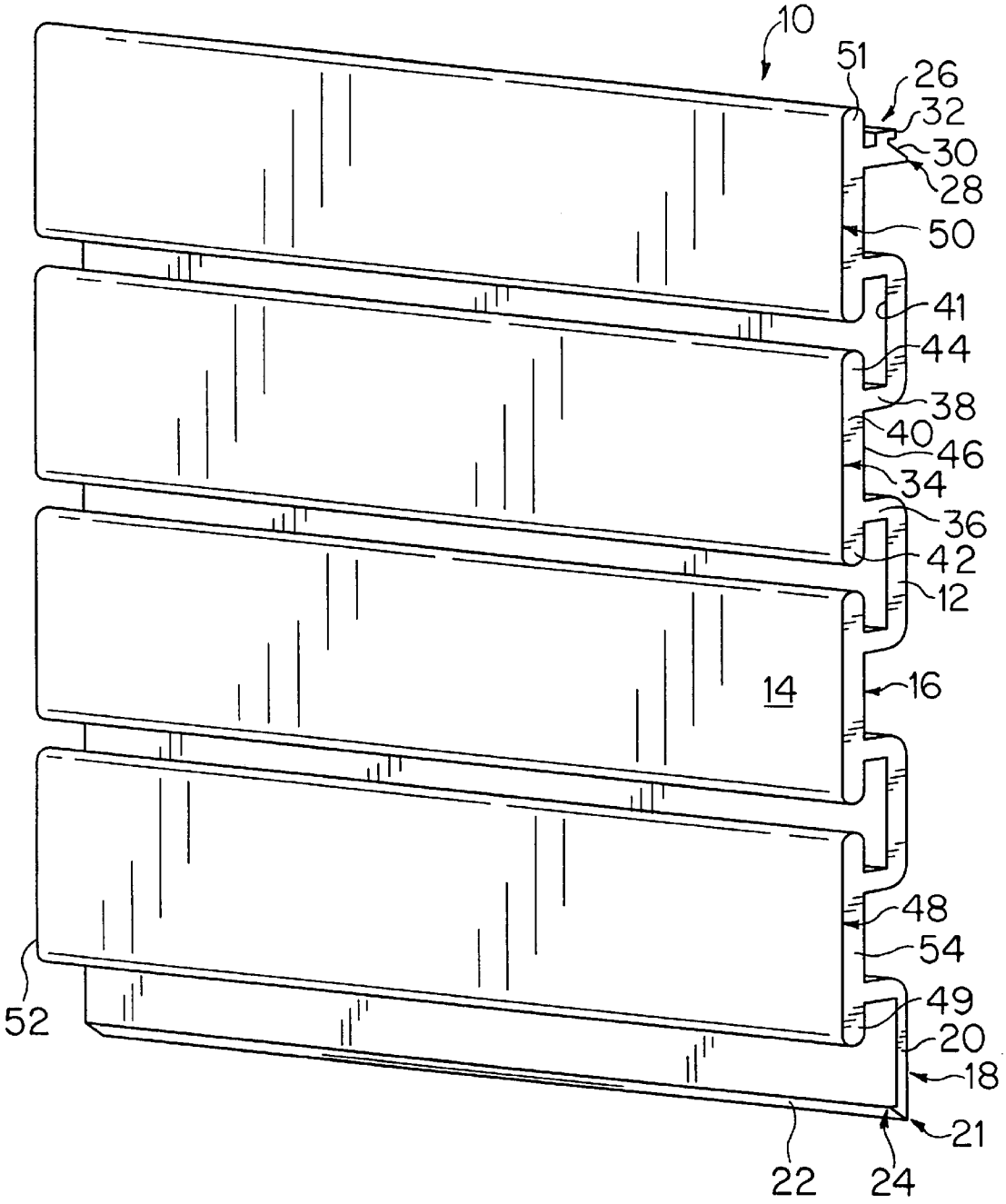
FIG. 1 is a front perspective view of an exemplary embodiment of a display wall section according to the present invention.
Figure 2:
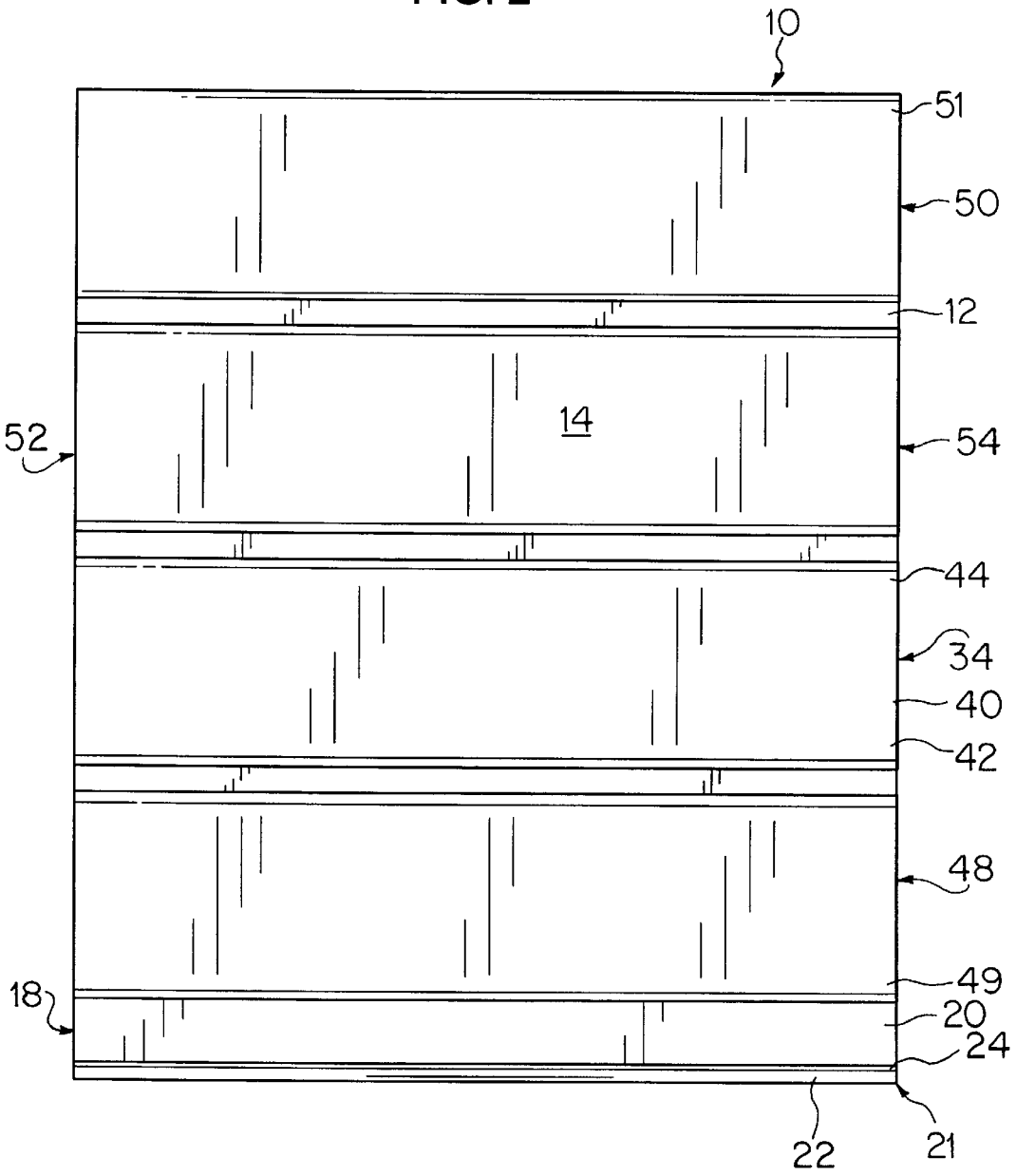
FIG. 2 is a front elevational view of the exemplary embodiment of a display wall section according to the present invention.
Figure 3:
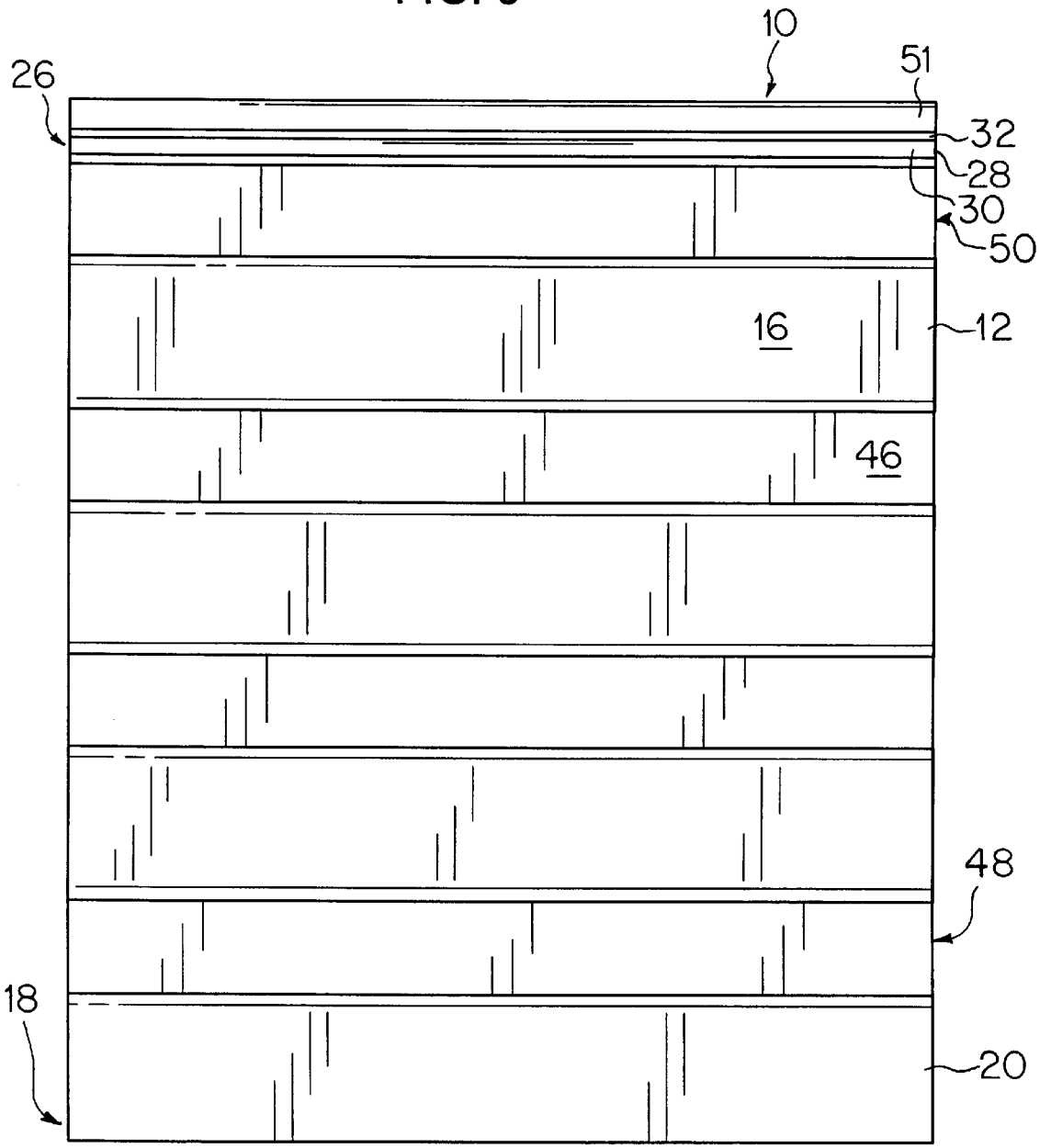
FIG. 3 is a rear elevational view of the exemplary embodiment of a display wall section according to the present invention.
Figure 4:
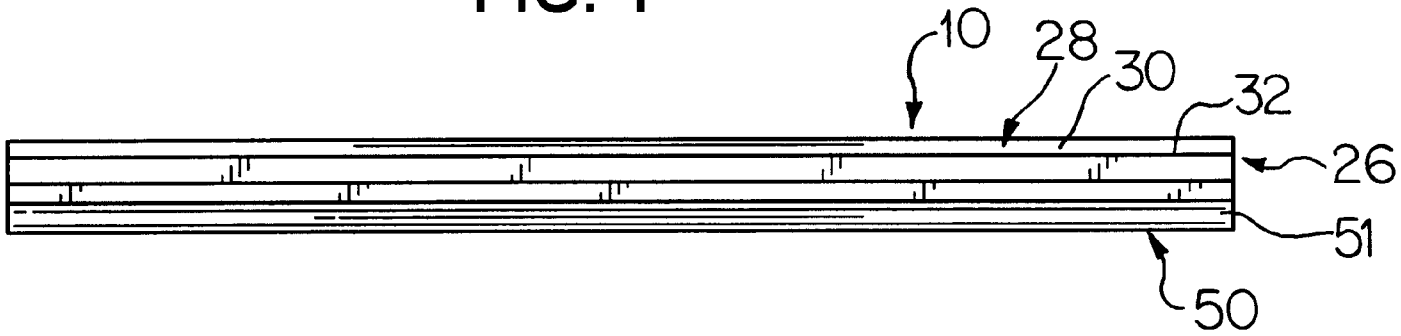
FIG. 4 is a top elevational view of the exemplary embodiment of a display wall section according to the present invention.
Figure 5:
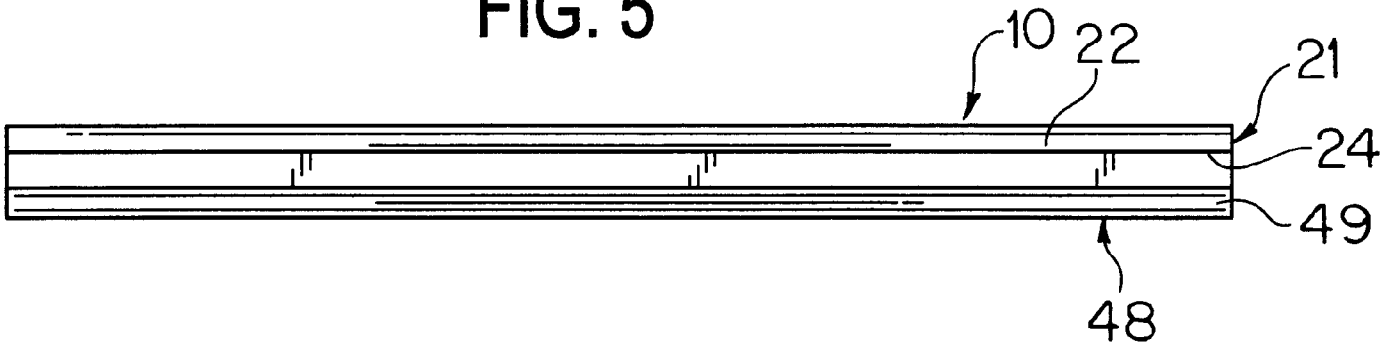
FIG. 5 is a bottom elevational view of the exemplary embodiment of a display wall section according to the present invention.
Figure 6:
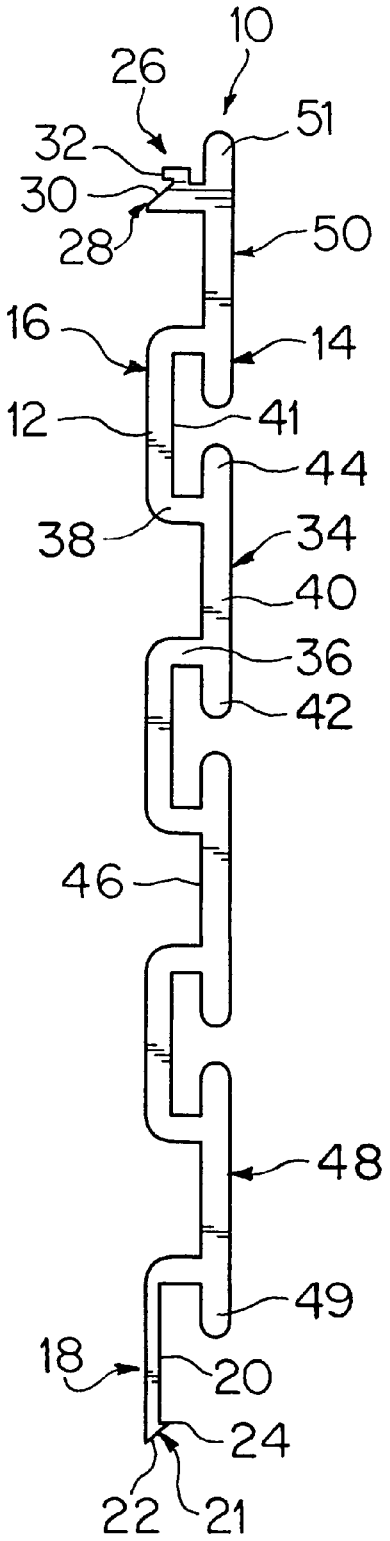
FIG. 6 is a left side elevational view of the exemplary embodiment of a display wall section according to the present invention, wherein the right side is a mirror image thereof.
Figure 7:
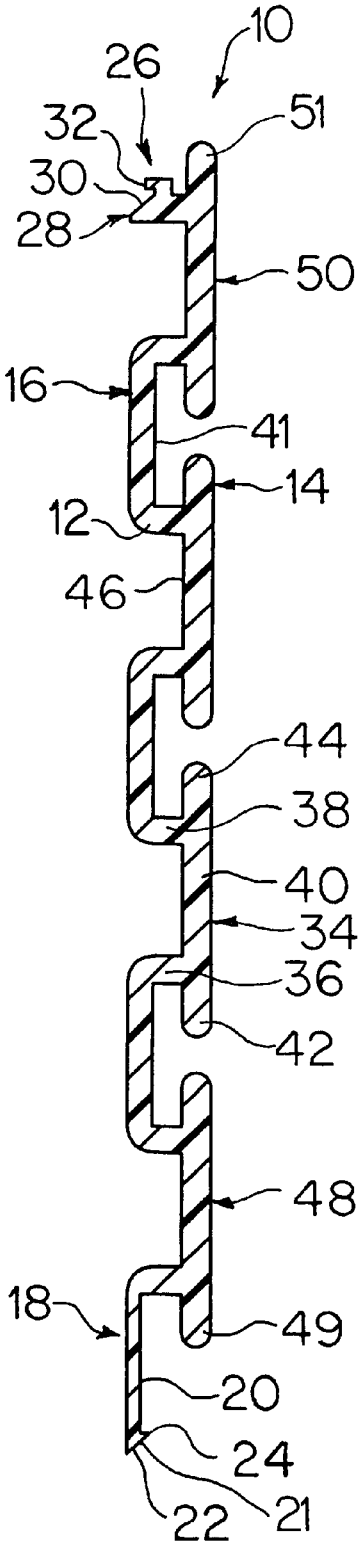
FIG. 7 is a cross-sectional view of an exemplary embodiment of a display wall section according to the present invention.

The exemplary embodiment, as depicted in FIG. 6, is a display wall section 10 that includes a base portion 12 having a front surface 14 and a rear surface 16. The base portion 12 of the display wall section 10 has a first end portion 18, a second end portion 26, and side edges 52 and 54. The base portion 12 preferably extends in a direction generally along a plane extending generally from the first end portion 18 to the second end portion 26, although alternative embodiments can have a curved configuration. Although not essential to the present invention, the exemplary embodiment of the present invention is constructed with a base portion 12 having one or more slats 34. The slats 34 are used for attaching display hooks (not depicted) that are anchored or positioned between adjacent slats and act as cantilever beams for hanging various display items or display shelves.

The base portion 12 is preferably formed to include one or more slats 34 that extend in a direction parallel with the plane of the base portion 12. The slats 34 are preferably evenly spaced and extending linearly along the base portion 12 in a parallel arrangement. The slats 34 of the exemplary embodiment all have identical cross-sectional shapes, whose overall general configuration resembles that of a "T." The slats 34 alternatively have L-shaped cross-sections and/or have differing shapes. The slats 34 of the exemplary embodiment include a first projection 36 and a second projection 38 extending in a direction perpendicular to the front surface 14 of the base portion 12, and a third portion 40 that extends in a direction parallel to the plane of the base portion 12. In the exemplary embodiment the first projection 36, the second projection 38, and the third projection 38 define a cavity 46 on the rear surface 16 of the base portion 12 behind the slats 34. The third portion 40 includes a first lip portion 42 and a second lip portion 44. The first lip portion 42 and the second lip portion 44 on the T-shaped slats 34 work in conjunction with lip portions on adjacent T-shaped slats to receive and hold display supports (not depicted).

In the exemplary embodiment of the present invention the first end portion 18 of the display wall section 10 includes an elongated section 20 that extends beyond an adjacent outermost slat 48. The elongated section 20 has a terminal end that includes an alignment member 21 that is preferably located beyond an adjacent lip portion 49 of the adjacent outermost slat 48. The alignment member 21 includes an inclined surface 22 that preferably begins at the rear surface 16 of the base portion 12 and extends in the direction of the front surface 14 at an oblique angle between zero and ninety degrees towards the adjacent outermost slat 48, and leads to a hook portion 24 that extends above the front surface 14 of the base portion 12. The alignment member 21 has a generally wedge-shaped cross-section. Note that the thickness of the base portion 12 is non-uniform since the elongated section 20 is preferably thin in cross-section when compared to the remainder of the base portion 12.

In the exemplary embodiment of the present invention the second end portion 26 of the display wall section 10 includes a recessed section 28 that extends beneath an adjacent outermost slat 50. The recessed section 28 is preferably located such that an adjacent lip portion 51 of an adjacent outermost slat 50 extends beyond the recessed section 28, thereby allowing the lip portion 51 to be used as a mounting surface for display hooks. The recessed section 28 is preferably formed such that the alignment member 21 of the first end portion 18 can be received therein and has a contour that is flush therewith. The recessed section 28 includes an inclined surface 30 leading to a protruding edge 32 that extends from the rear surface 16 of the base portion 12. The recessed section 28 is preferably integral with a projection of the adjacent outermost slat 50. Note that the recessed section 28 is relatively thick in comparison to the remainder of the base portion 12. An alignment member of a display wall section can be used in conjunction with a recessed portion of an adjacent display wall section to help align the display wall sections during construction of a display wall system.

Figure 8:
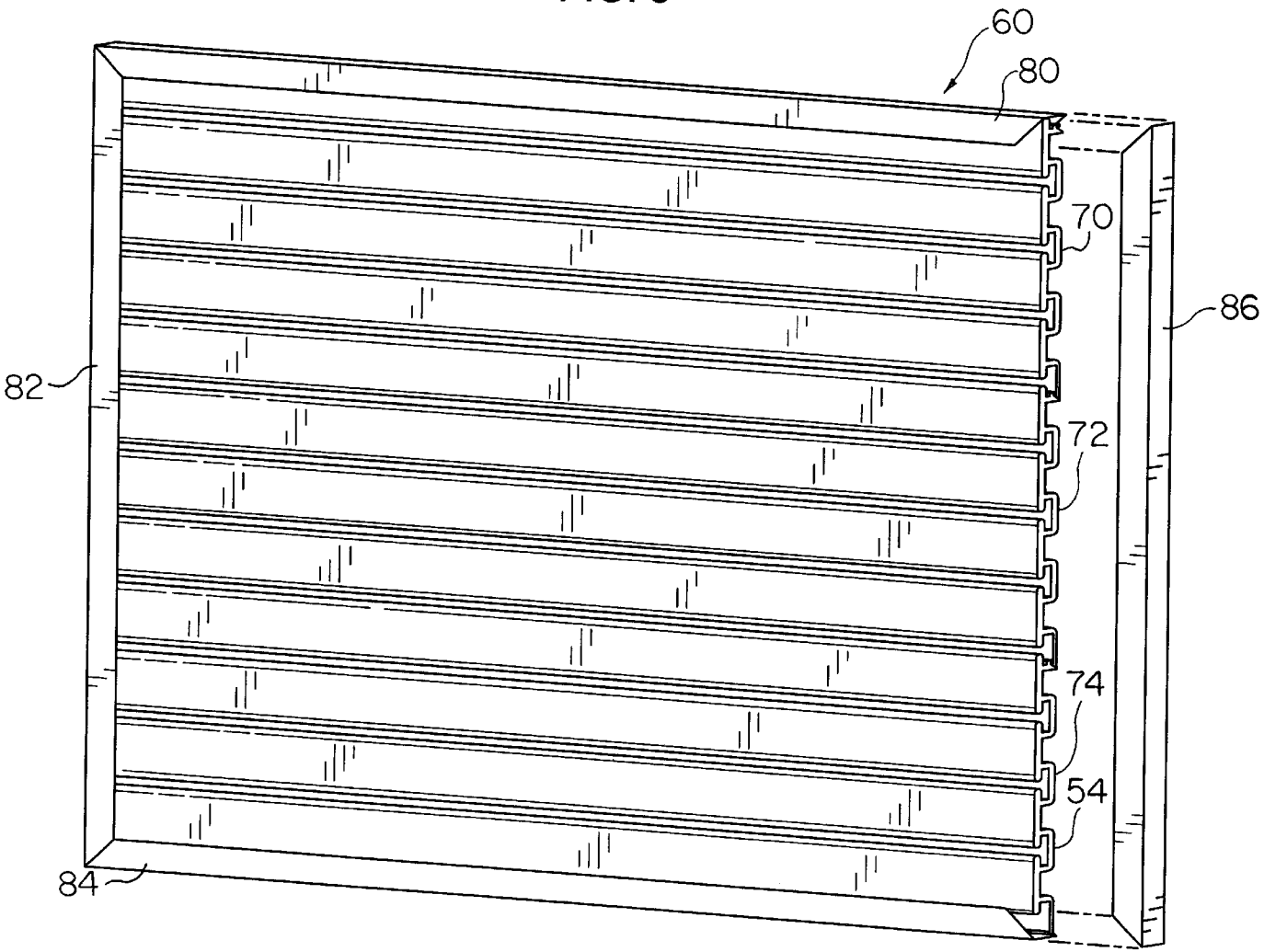
FIG. 8 is a partially exploded, front perspective view of an exemplary embodiment of a display wall system according to the present invention.
Figure 9:
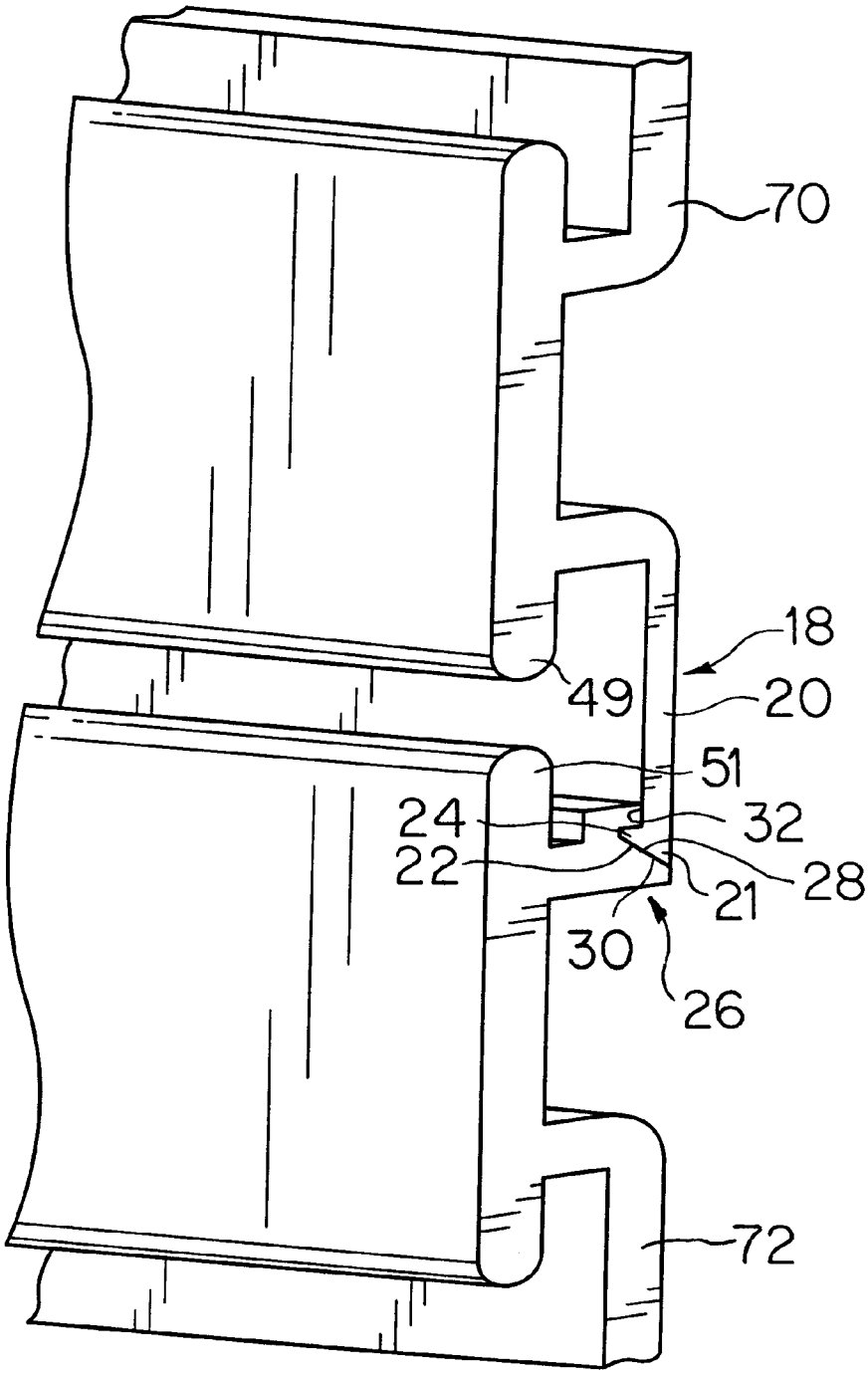
FIG. 9 is an enlarged partial, front perspective view of a connection between adjacent display wall sections of the exemplary embodiment of a display wall system depicted in FIG. 8.
Figure 10:
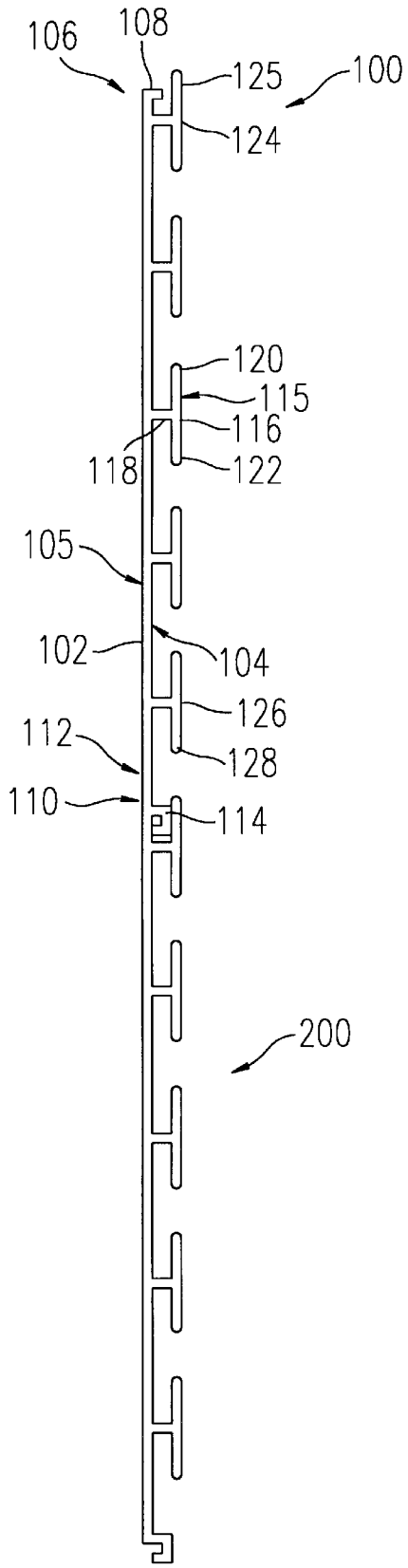
FIG. 10 is a side elevational view of a conventional slatwall section.

FIGS. 8 and 9 depict an exemplary embodiment of a display wall system 60 according to the present invention. The display wall system 60 depicted in FIG. 8 includes a first display wall section 70, a second display wall section 72, and a third display wall section 74, all of which include the features of the exemplary embodiment of the display wall section 10 depicted in FIGS. 1–7. The display wall system 60 further includes a first edge member 80, a second edge member 82, a third edge member 84, and a fourth edge member 86. The edge members have a U-shaped cross-section and are shaped to fit tightly over side edges 52 and 54, the first end portion 18, and the second end portion 26 of the display wall section 10. The edge members 80, 82, 84, and 86 are constructed to provide an aesthetically pleasing appearance to the display wall system 60 by hiding the edges of the display wall system 60, and to prevent display racks held by the slats 34 from sliding off the edges, 52 and 54, of the display wall sections 10.

The display wall section 10 is positioned on a supporting surface (not depicted) with either the first end portion 18 or the second end portion 26 positioned at the top, and with the slats 34 extending in a horizontal direction. Once a first display wall section is mounted on the supporting surface a second display wall section can be positioned below the first display wall section such that the alignment member 21 of the second display wall section is received within the recessed section 28 of the first display wall section. Notice that since the first display wall section is mounted to a supporting surface and therefore the recessed section 28 is positioned near the wall, as the second display wall is slid into position adjacent the first display wall, the hook portion 24 of the first display wall will slightly interfere with the protruding edge 32 of the second display wall. Consequently, the alignment member 21 of the first display wall can be pushed against the recessed section 28 of the second display wall such that the alignment member 21 snaps into position within the recessed section 28 as depicted in FIG. 9, and thereby the protruding edge 32 of the second end portion 26 tends to hold the hook portion 24 of the alignment member 21 within the recessed section 28. Once the alignment member 21 of the first display wall is moved within the recessed section 28 of the second display wall, the first display wall facilitates the alignment and installation of the second display wall on the supporting surface by either holding the second display wall section in place or at least provide an easy reference by which the second display wall section can be aligned. Once the desired number of display wall sections is mounted, various display supports can be positioned between the slats 34 for displaying items.

The preferred symmetrical T-shape of the slats 34 allows the display wall sections 10 of the display wall system to be mounted either with the first end portion 18 positioned above the second end portion 26, or with the display wall sections 10 inverted. Such a configuration eliminates the potential for errors in mounting the display wall. The shape of the slats 34 also defines a large recess 41 between adjacent slats that allows the display wall construction to receive and support a broad variety of display supports having different shapes. Furthermore, the slats 34 include both a first lip portion 42 and a second lip portion 44 that advantageously provide two distinct supporting surfaces that can be used to hold a variety of display supports.

The display wall sections 10 can be mounted to a supporting surface (not depicted) using a variety of different mechanisms. For example, the display wall sections 10 can be mounted to a support surface using an adhesive material that is applied to a portion of or to the entire rear surface 16 of the base portion 12. Some examples of adhesive material that could be used include double-sided tape, various types of glues or epoxies, or other similar materials. Alternatively, hook and loop type fasteners could be used by attaching mating pieces to both the display wall sections 10 and the supporting surface. The display wall sections 10 could be mounted to the supporting surface using nails, screws, or nuts and bolts, with such devices preferably extending through the display wall section at a location beneath the first lip portion 42 or the second lip portion 44 of the slats 34. The display wall sections 10 can also be mounted by hanging on hooks or by stringing wire or cord under the lip portion of various slats 34 and attaching the wire to a structure, thereby holding the display wall sections 10 against the support surface. Note, however, that the recessed section 28 is preferably not attached to the supporting surface since the recessed portion should be allowed to flex away from the supporting surface during insertion of the alignment member 21 therein.

The display wall sections 10 and the edge members, 80, 82, 84, and 86, are preferably manufactured using extrusion technology as will be appreciated by one skilled in the art. The display wall sections 10 and edge members, 80, 82, 84, and 86, are preferably extruded parts made from materials such as various forms of plastic material, various composite materials including materials such as plastic and wood grain materials, or other similar materials. The present invention can also be made as non-extruded parts, and using materials other than those listed above, for example, various types of metals (aluminum, steel, various alloys, etc.), ceramic materials, various composite materials, wood, and other similar materials.

The display wall section 10 depicted in FIGS. 1–7 and the display wall system depicted in FIGS. 8 and 9 provide an aesthetically pleasing product with a unique ornamental appearance. The ornamental features of the display wall section and the display wall system are contemplated as being a part of the invention disclosed herein.

In the previous descriptions, numerous specific details are set forth, such as specific materials, structures, processes, etc., in order to provide a thorough understanding of the present invention. However, as one having ordinary skill in the art would recognize, the present invention can be practiced without resorting to the details specifically set forth. In other instances, well known processing structures have not been described in detail in order not to unnecessarily obscure the present invention.

Only the preferred embodiment of the invention and an example of its versatility are shown and described in the present disclosure. It is to be understood that the invention is capable of use in various other combinations and environments and is capable of changes or modifications within the scope of the inventive concept as expressed herein.

What is claimed is:

1. A display wall section comprising:

a base portion having a first end portion and a second end portion, said base portion having a first slat and a second slat, said base portion defining a cavity between said first slat and said second slat that is adapted to receive a display member for supporting a display item;

said first end portion having an alignment member with an inclined surface protruding from said base portion;

said second end portion having a recessed section adapted to receive an inclined surface from an adjacent display wall section; and said first slat having a lip portion that extends in a direction opposite said first end portion and covers said recessed section.

2. The display wall section according to claim 1, wherein said first slat and said second slat are configured in a parallel relationship.

3. The display wall section according to claim 1, further comprising a means for mounting said display wall section to a surface.

4. The display wall section according to claim 1, wherein said recessed section is integral with said first slat.

5. The display wall section according to claim 1, further comprising an adhesive on a rear surface of said base portion, said adhesive being adapted to connect said display wall section to a surface.

6. The display wall section according to claim 1, wherein said first slat and said second slat each have a generally T-shaped cross-section.

7. The display wall section according to claim 1, wherein said base portion extends generally along a plane and wherein said lip portion extends generally parallel to the plane.

8. The display wall section according to claim 1, wherein said base portion extends generally along a plane and wherein said second slat comprises a lip portion that extends in a direction opposite from said second end portion and generally parallel to the plane, said second slat being positioned adjacent said first end portion such that said inclined surface is positioned beyond said lip portion of said second slat.

9. The display wall section according to claim 1, wherein:

said base portion extends generally along a plane;

said inclined surface terminates in a hook portion; and said recessed section comprises a protruding edge adapted to extend below a hook portion of an adjacent display wall section having an alignment member received within said recessed section whereby the hook portion of the adjacent display wall section is constrained within said recessed section by said protruding edge of said display wall section if said display wall section and the adjacent display wall section are pulled in opposite directions from each other along the plane.

10. The display wall section according to claim 1, wherein said display wall section is made of an extruded material.

11. The display wall section according to claim 1, further comprising a U-shaped member positioned over a side edge of said base portion.

12. The display wall section according to claim 1, wherein:

said base portion extends generally along a plane;

said base portion has a first projection extending in a direction generally perpendicular to the plane and connected to said first slat, and a second projection extending in a direction generally perpendicular to the plane and connected to said second slat; and said cavity is defined between said first slat, said first projection, said second slat, and said second projection.

13. The display wall section according to claim 12, wherein:

said first slat comprises a first lip portion that protrudes beyond said first projection in a first direction generally parallel to the plane; and said second slat comprises a second lip portion that protrudes beyond said second projection in a second direction generally parallel to the plane, such that said first lip portion and said second lip portion protrude towards each other.

14. The display wall section according to claim 12, wherein said recessed section is integral with said first projection.

15. A display wall system comprising:

a first display wall section comprising a base portion having an end portion including an alignment member with an inclined surface protruding from said base portion, said base portion having a slat; and a second display wall section comprising a base portion having an end portion including a recessed section adapted to receive said inclined surface of said first display wall section, said base portion of said second display wall section having a slat, said slat of said first display wall section and said slat of said second display wall section defining a cavity that is adapted to receive a display member for supporting a display item, said slat of said second display wall section having a lip portion that extends in a direction towards said first display wall section and covers said recessed section.

16. The display wall system according to claim 15, further comprising a U-shaped member positioned over a side edge of said first display wall section and a side edge of said second display wall section.

17. The display wall system according to claim 15, wherein said slat of said first display wall section has a generally T-shaped cross-section and said slat of said second display wall section has a generally T-shaped cross-section and is configured in a parallel relationship with said slat of said first display wall section.

18. The display wall system according to claim 15, wherein said base portion of said second display wall section extends generally along a plane, said base portion of said second display wall section further comprising a projection extending in a direction generally perpendicular to the plane and connected to said slat of said second display wall section, said recessed section of said second display wall section being integral with said slat of said second display wall section.

19. The display wall system according to claim 15, wherein:

said base portion of said first display wall section and said base portion of said second display wall section extend generally along a plane;

said inclined surface terminates in a hook portion; and said recessed section comprises a protruding edge adapted to extend below said hook portion when said alignment member is received within said recessed section whereby said hook portion is constrained within said recessed section by said protruding edge if said first display wall section and said second display wall section are pulled in opposite directions from each other along the plane.

20. The display wall system according to claim 15, further comprising a means for mounting said display wall system to a surface.

* * * * *